US006160898A

United States Patent [19]

Bachmann et al.

[11] Patent Number: 6,160,898

[45] Date of Patent: Dec. 12, 2000

[54] SUSPENSION MOUNT FOR SOUND REPRODUCTION DEVICES ACCORDING TO THE FLEXURAL WAVE PRINCIPLE

[75] Inventors: Wolfgang Bachmann, Grevenbroich; Gerhard Krump, Schwarzach; Hans-Jürgen Regl, Düsseldorf, all of Germany

[73] Assignee: Nokia Technology GmbH, Germany

[21] Appl. No.: 09/216,155

[22] Filed: Dec. 18, 1998

[30] Foreign Application Priority Data

Dec. 20, 1997 [DE] Germany ..... 197 57 098

[51] Int. Cl.[7] ..... H04R 25/00

[52] U.S. Cl. ..... 381/425; 381/398

[58] Field of Search ..... 381/152, 423, 381/424, 425, 431, 337, 398, FOR 162

[56] References Cited

U.S. PATENT DOCUMENTS

| | | | |
|---|---|---|---|
| 2,063,945 | 12/1936 | Pierce | 381/356 |
| 2,744,042 | 5/1956 | Pace | 264/46.5 |
| 3,347,335 | 10/1967 | Watters et al. | 381/354 |
| 4,122,314 | 10/1978 | Matsuda et al. | 381/425 |
| 4,198,550 | 4/1980 | Matsuda et al. | 381/354 |
| 4,272,653 | 6/1981 | Osato et al. | 381/425 |
| 4,322,584 | 3/1982 | Shimada et al. . | |
| 4,410,768 | 10/1983 | Nakamura et al. | 381/423 |
| 4,471,173 | 9/1984 | Winey | 381/408 |
| 5,574,797 | 11/1996 | Geisenberger | 381/398 |
| 6,044,925 | 4/2000 | Sahyoun | 181/157 |

FOREIGN PATENT DOCUMENTS

| | | | |
|---|---|---|---|
| 2946618 | 5/1980 | Germany . | |
| 3907540 | 12/1989 | Germany . | |
| 56-34342 | 9/1982 | Japan | 381/162 |
| 61-009098 | 1/1986 | Japan | 381/162 |
| 9709840 | 3/1997 | WIPO . | |

*Primary Examiner*—Curtis A. Kuntz
*Assistant Examiner*—Phylesha Dabney
*Attorney, Agent, or Firm*—Ware, Fressola, Van Der Sluys & Adolphson LLP

[57] ABSTRACT

The invention proposes a suspension mount for sound reproduction devices according to the flexural wave principle. Characteristic for such devices is that a panel 10 is provided which must be flexibly attached to a holder 17. The panel 10 is composed of a core layer with a perforated structure, and two cover layers 12 which cover the core layer 11. Since the usual edge borders of conventional loudspeakers must be designed very hard due to the size and weight of the panel 10, the quality of the sound reproduction by such a device is reduced. For that reason the objective of the invention is a suspension mount which avoids the drawbacks of the state of the art. To that end it is proposed to build the suspension mount with the core layer 11 and/or at least one of the cover layers 12. If the core layer 11 itself provides the flexible attachment, it is also possible without any great effort to flexibly attach the panel 10 away from the edge areas. In that case the flexibility of the perforated structure of the core layer 11 is used as a spring element.

10 Claims, 3 Drawing Sheets

SUSPENSION MOUNT FOR SOUND REPRODUCTION DEVICES ACCORDING TO THE FLEXURAL WAVE PRINCIPLE

CROSS-REFERENCE TO RELATED APPLICATIONS

This patent application discloses subject matter that is disclosed and may be claimed in copending U.S. patent applications having Ser. Nos. (09/216,154 and 09/216,344), both filed on even date herewith.

TECHNICAL FIELD

The invention concerns suspension mounts for sound reproduction devices according to the flexural wave principle, particularly those suspension mounts which permit any type of integration of such devices into installation openings without hindering the flexural wave propagation.

BACKGROUND OF THE INVENTION

Sound reproduction devices which operate in accordance with the flexural wave principle are known in the state of the art. Such devices are essentially composed of a panel and at least one drive system, and the panel oscillates when sound signals are transmitted to the drive system or systems. It is characteristic for such sound reproduction devices that a flexural wave radiation starts at a critical lower frequency, where the flexural wave leads to the radiation of sound in a frequency-dependent direction along the plane of the respective panel. In other words, a cut through a directivity diagram shows a principal lobe whose direction is frequency-dependent. These relationships apply fully to infinitely expanded plates and absorber plates, while the relationships for the multi-resonance plates covered by this application are clearly more complex because of the strong edge reflexes. This complexity of the multi-resonance plates is due to the fact that the named principal lobe has a number of such further principal lobes superimposed on it in a frequency-dependent direction, so that a highly fan-shaped directivity diagram is created which furthermore is very frequency-dependent. However the multi-resonance plates and the absorber plates treated here have in common that the center of their directivity diagram rather points away from the mid-perpendicular. This property causes the room to have a stronger effect on the projection of the sound waves.

The panel is constructed according to the sandwich principle, where each of two opposite surfaces of a very light core layer are attached to a thin cover layer, for example by means of an adhesive. In order for the panel to have good sound reproduction properties, the material for the cover layer must have an especially high dilatational wave speed. Suitable cover layer materials are for example thin metal foils or fiber-reinforced plastic foils as well.

Special demands are also made on the core layer. Thus in the first place it is necessary for the materials being used to have a low mass density and low damping. In addition the materials for the core layer must have as high a vertical shear modulus as possible with respect to the sides which are provided with the cover layers. Finally in the sense of a principal requirement, it is necessary for the materials that can be used for the core layers to have a very low modulus of elasticity along the direction in which the greatest expansion of the subsequently formed core layer takes place. These two premises, which at first glance are contradictory in reference to the last two requirements, are better fulfilled by a core layer which has a perforated structure with openings of a preferably small cross section which extend between the two surfaces to be covered by the cover layers. In addition to the core layers with the perforated structure, hard foams can also be used as core layer materials because despite their isotropic properties, these materials still exhibit suitable shear and elasticity moduli. In this connection it should also be mentioned that when hard foams are used as the core layer material, the objective of the cover layers is to produce the necessary anisotropic behavior of the panel.

It was the basic idea of the sound reproduction according to the flexural wave principle to use existing walls to radiate the sound. It was first assumed that to produce flexural waves it would suffice to equip the corresponding walls with drive systems. It was soon learned that only walls which had been optimized for this purpose were in a position to guarantee a satisfactory sound radiation. But a prerequisite was that walls optimized in this manner would be available in sufficient size to prevent damping the propagating waves against a rigidly boxed panel. However it is often the case that surfaces which are able to receive a panel of the above described size are not available. To enable the use of small panels as well for an acceptable sound reproduction, it is necessary to attach these to a holder by means of flexible fasteners. To that end the beads known from loudspeaker technology, which connect the edge of the panel with the holder, could be used. Aside from the fact that the known beads represent an additional component, these beads are also a disadvantage because the steps needed to install the beads make the production process considerably more expensive. Irrespective thereof, the edge attachment of smaller size panels is also disadvantageous if the corresponding panel is equipped with a number of drive systems, as is the usual practice. This measure increases the weight of the already heavy panel, and the beads must therefore be very hard to sufficiently suspend the panel, which at the same time increases the damping that is caused by these beads.

SUMMARY OF THE INVENTION

It is therefore the objective of the invention to propose a suspension mount for sound reproduction devices according to the flexural wave principle which avoids the drawbacks that exist in the state of the art.

This objective is achieved by a suspension mount for sound reproduction devices according to the flexural wave principle, with a panel which is composed of a core layer and two cover layers, where the two cover layers are connected to two opposite sides of the core layer, with a holder and with flexible fastening devices which attach the panel to the holder, wherein the flexible fastening devices are formed by the core layer and/or by at least one of the two cover layers.

The inventive aspect of the present application is that the components used to produce the panel are suitable for producing a flexible connection with a holder.

If the core layer has a perforated structure, where each opening of this perforated structure is vertical with respect to the two cover layers, and if a fastening part is inserted through at least one of the openings to attach the panel to the holder, the perforated structure of the core material which is flexible anyway can be used for the flexible attachment, if at least one of the two cover layers is placed at a lateral distance A1 from the opening or openings containing the fastening part, in that a number of the laterally adjacent opening or openings containing the fastening part are not covered by the cover layer or layers. It is unimportant whether the respective fastening part extends parallel or crosswise to the direction of the openings.

To prevent the opening or openings containing the fastening part from being torn out, the opening or openings containing the fastening part, and/or the openings which are laterally adjacent to the opening or openings containing the fastening part, are filled with a plastic foam.

To ensure the spring action in the foam-filled openings as well, at least one of the two cover layers is also placed at a distance A2 from the openings that are filled with the plastic foam material.

A further improved spring action is achieved if the opening or openings containing a fastening part, and/or those openings which are not covered, or are only covered by one of the two cover layers, have a smaller length than the openings in the rest of the core layer.

Because of the material constitution of the cover layers they can also be simultaneously used as suspension mounts for the panel by bridging the space A between the panel and a holder which boxes in the panel. A further advantage of such a suspension mount is that using the cover layers creates a stepless transition between the holder and the panel without any great effort.

An improved spring action is provided to the cover layer or layers if the area of the cover layer that bridges the space A between the panel and the holder has a corrugated or scalloped profile.

The sound reproduction device is particularly space-saving if the electronic components for driving the panel are placed in the space A between the panel and the holder. The electronic components do not increase the oscillating mass when they are connected to the holder. In addition, the attachment of the electronic components to the holder improves the dissipation of heat from the electronic components.

For reasons of completeness alone it should be pointed out that the respective panel can also be fastened by a combined core layer and cover layer suspension, where for example one of the cover layers is guided to the holder and the panel is supported away from the edge area by the effect of the core layer.

BEST MODE FOR CARRYING OUT THE INVENTION

The invention will now be explained in greater detail by means of the figures.

Figure 1:
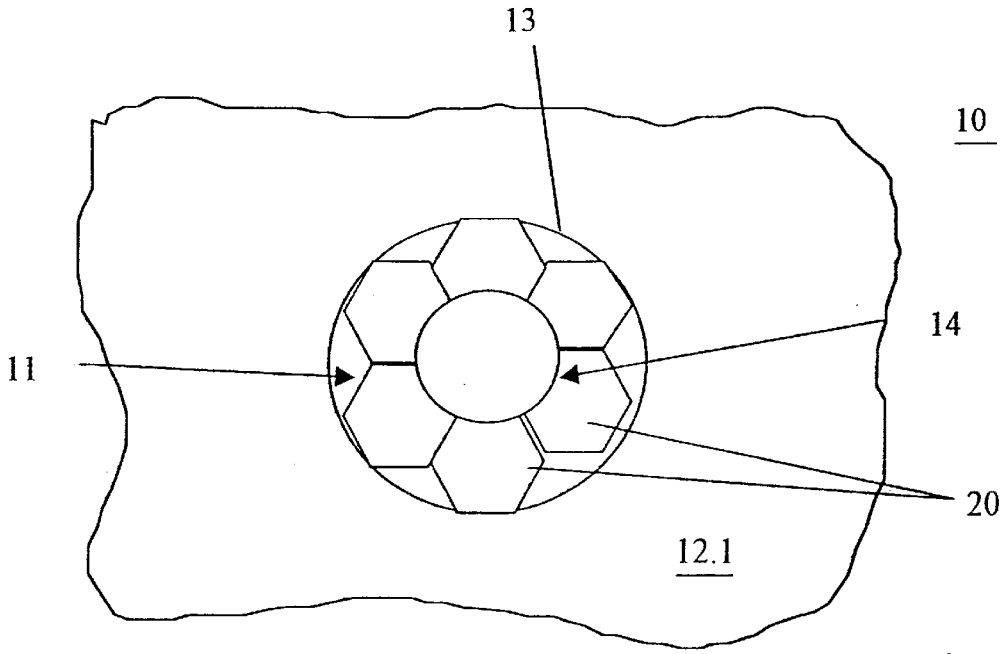
FIG. 1 is a top view of a panel.

The panel 10 illustrated in a top view in FIG. 1 is formed of a core layer 11, a top cover layer 12.1 and a bottom cover layer 12.2 which is not visible in FIG. 1, where the two cover layers 12 are connected to opposite sides of the core layer 11. The core layer 11 has a perforated structure which is formed of a number of openings 20 with a honeycomb-shaped cross section. The honeycomb-shaped openings 20 extend vertically to the planes of the two cover layers which undergo the greatest expansion.

Even if all the openings 20 shown in the embodiments have a honeycomb-shaped cross section, it does not involve any restriction of this cross sectional form. This means that the openings 20 in other configurations can also have round or angular cross-sections.

As can clearly be seen in FIG. 1, the core layer 11 is not entirely covered by the two cover layers 12. Rather an area 13 in the two cover layers 12 is left uncovered, through which the core layer 11 becomes visible. A fastening part in the form of a screw 14 is inserted into the central opening 20 (visible in FIG. 1). In that case the head 15 of the screw 14 rests against the core layer 11. If required for example a foam washer (not illustrated) can also be placed between the core layer and the head 15 of the screw 14. It can also be seen in FIG. 2 that the opening 20 which contains the shaft 16 of the screw 14, as well as the openings 20 which are directly adjacent to said opening 20, have a reduced length L2 with respect to the other openings 20 in the core layer 11 which have a length L1. This reduced length L2 of the openings 20 allows them to be easier to deform crosswise to the direction of the shaft 16 of screw 14, as opposed to the openings 20 with a length L1.

Figure 2:
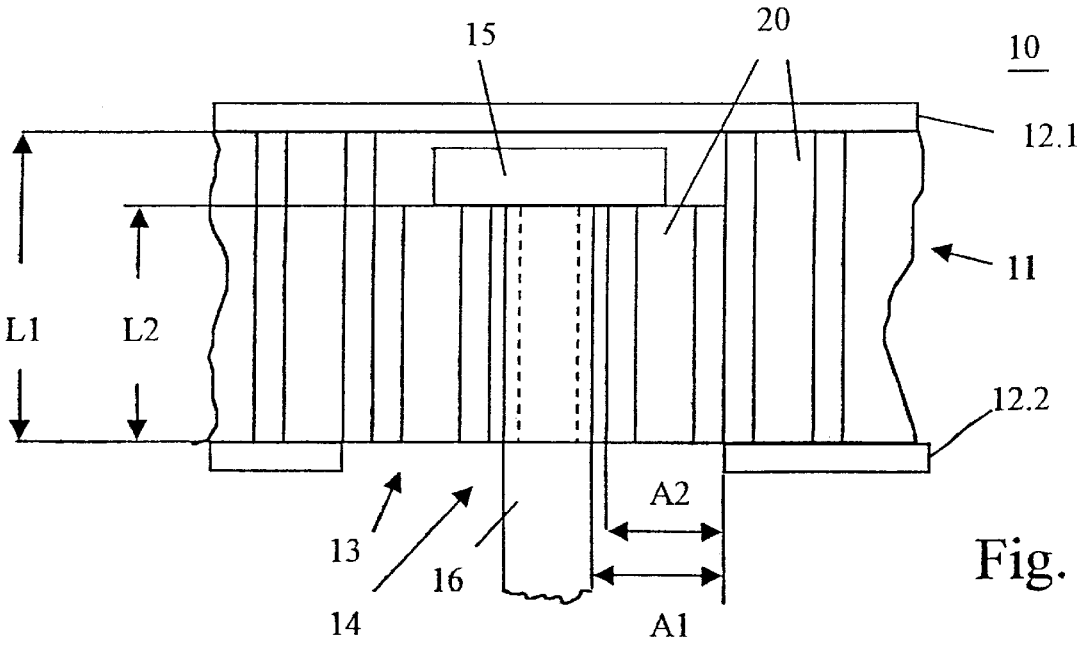
FIG. 2 is a cross sectional view of a panel according to FIG. 1.

The dotted lines in FIG. 2 further show that the opening 20 through which the shaft 16 of screw 14 passes is filled with a plastic foam material. This prevents this opening 20 from being damaged when the shaft 16 of screw 14 is attached to a holder (not illustrated) and the panel 10 is deformed into corrugations.

For reasons of completeness alone it should be pointed out that in FIG. 2 the top cover layer 12.1 over the openings 20 with the reduced length L2 has no open area 13 which does not cover the core layer 11, but fully covers said openings 20 as well. This creates a continuous surface on the top cover layer 12.1, which improves the optics of such a panel 10.

It can furthermore be seen in FIG. 2 that to improve the spring action of the core layer, the area 13 of the bottom cover layer 12.2 has a space A1 with respect to the screw 14 and a space A2 with respect to the foam fill. It is essential in this case that the space A1 is greater than the space A2, because only when these conditions are met can a free spring action be assured from the use of the core layer 11.

Figure 3A:
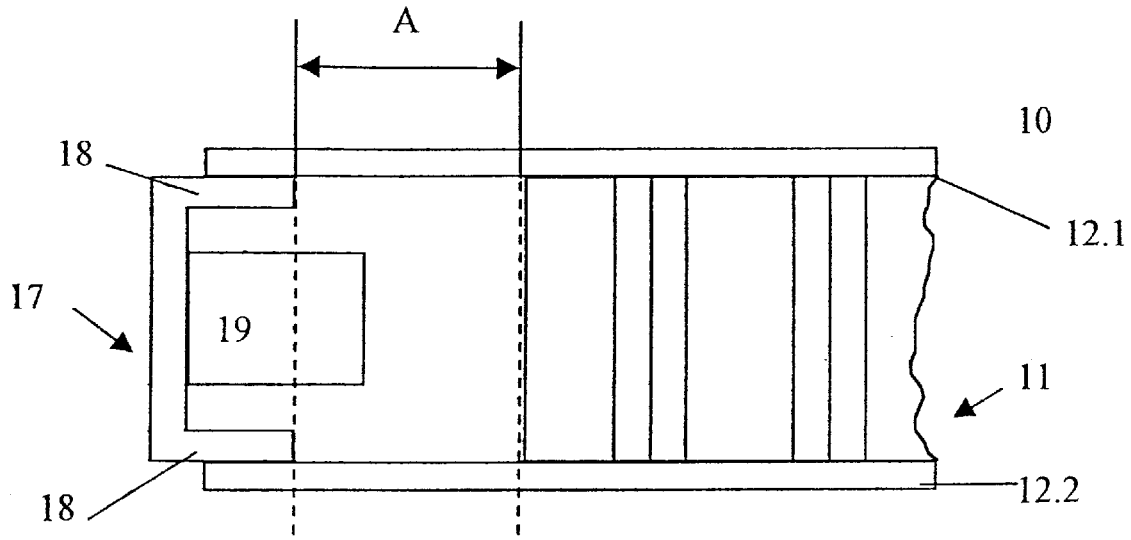
FIG. 3*a–c* are three cross sectional views of another panel.
Figure 3B:
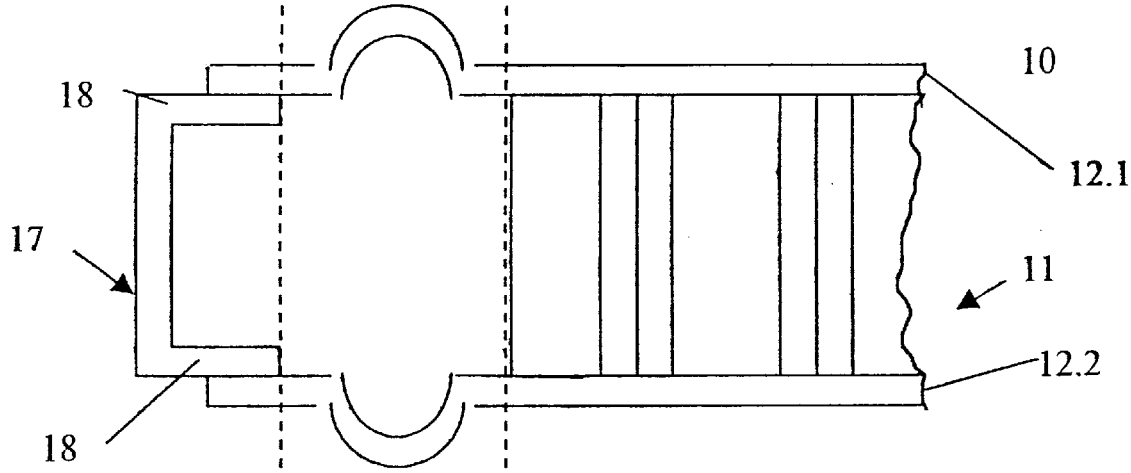
Figure 3C:
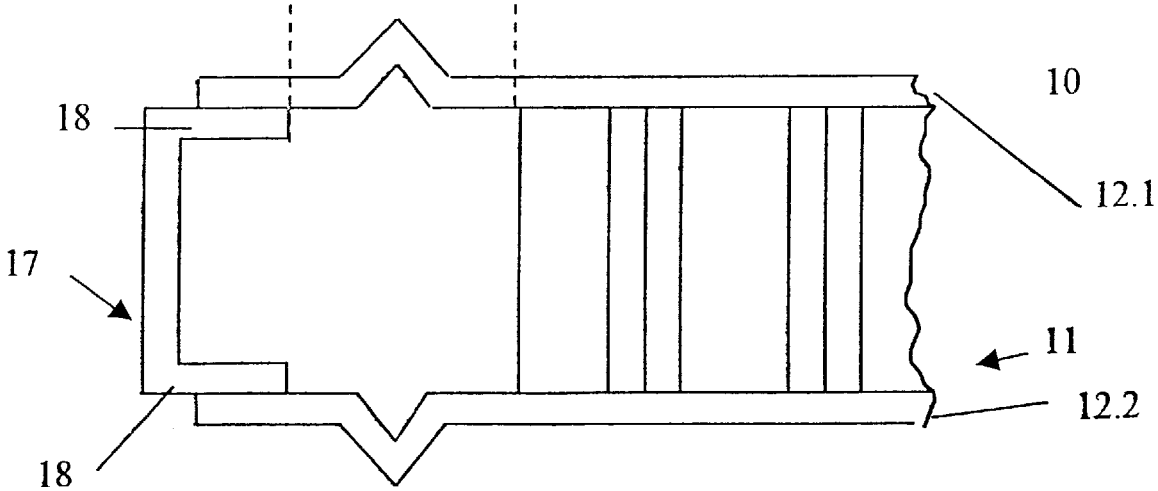

FIGS. 3*a–c* illustrate a suspension mount that is entirely different from the suspension mount in FIGS. 1 and 2, although both suspension types can be used to suspend a panel 10.

In the arrangement according to FIGS. 3*a–c* the panel 10 is boxed in by a holder 17 next to a lateral space A. This holder 17 has a U-shaped profile where the free ends 18 of the profile point in the direction of the panel 10.

In the configuration in FIG. 3*a*, the two cover layers 12.1, 12.2 which are connected to the core layer 11 form a flat bridge over the space A and are attached to the ends 18 of the profile. In order to very simply achieve a certain tension in the cover layers 12 when they are attached to the ends 18 of the holder 17 which boxes in the panel 10, the ends 18 can also have a (not illustrated) scalloped profile. If the respective cover layer 12 is then placed on a scalloped end 18 of the surrounding holder 17 and is pressed into the end 18 by means of a complementary scalloped tool, a tension is created in the cover layer 12 which remains in effect for example after the adhesive between the ends 18 and the cover layer 12 has set. However, other methods known to the expert can be used to build up tension in the cover layer 12 which is attached to the holder 17.

It can be seen in FIGS. 3*b* and *c* that the two cover layers 12 need not extend to the holder 17 in the plane of the panel, but can also be arched (FIG. 3*b*) or scalloped (FIG. 3*c*) in the area where they bridge over the space A. Nor are the arches or the scallops of the cover layers 12 in the area of the space A restricted to arches or scallops. It should further be emphasized that the shape, the thickness and the material characteristics of the cover layers 12.1, 12.2 define the spring properties. It should finally be pointed out that it is not necessary that both cover layers 12.1, 12.2 of the panel 10 are attached to the holder 17.

The number 19 in the configuration in FIG. 3*a* refers to electronics which interact with the (not illustrated) drive system or systems for the panel 10. These electronics 19 are connected to the holder 17, which provides good heat dissipation from the panel 10.

Figure 4:
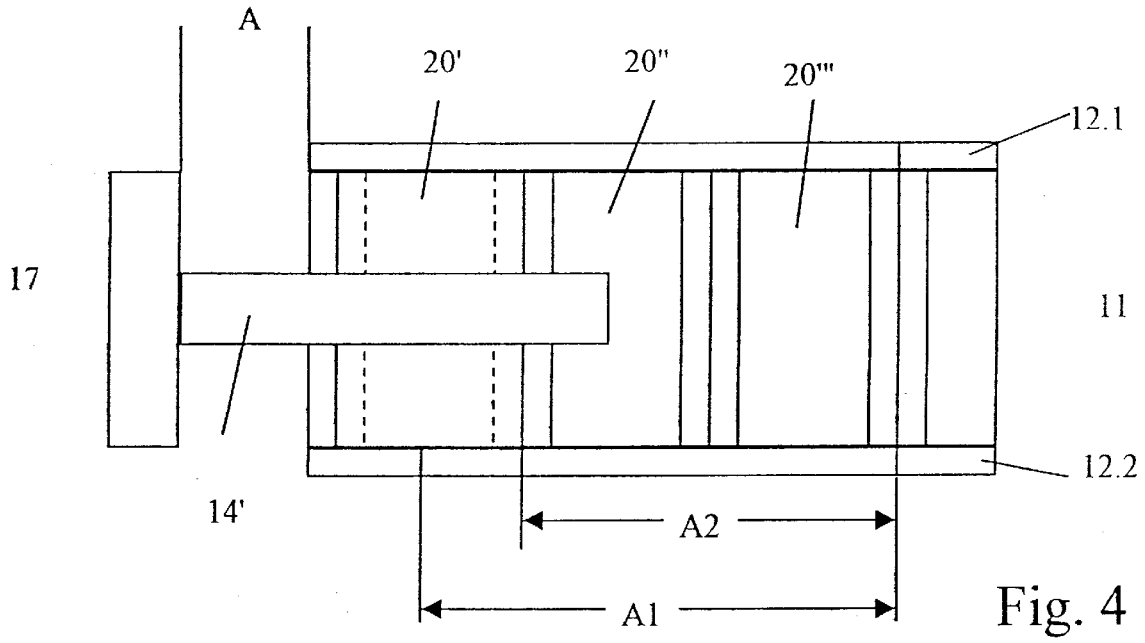
FIG. 4 is a cross sectional view of another panel.

The embodiment in FIG. 4 is linked to the configuration in FIGS. 1 and 2. In contrast to the last cited configurations, the fastening part has the form of a lug 14' and is attached to the panel 10 crosswise to the direction in which the openings 20 extend. To provide for sufficient attachment of the lug 14' in the panel 10, the opening 20' through which the lug 14' passes is completely filled with a plastic foam material. In addition the openings 20' to 20''' are not equipped with any top or bottom cover layer 12.1, 12.2, to improve the flexibility of the openings 20'' and 20''' crosswise to their direction. It should also be mentioned in connection with the configuration in FIG. 4 that the spaces A1 and A2 illustrated in this figure not only apply crosswise to the line of sight, but also vertically.

In case the spring action over the openings 20'', 20''' is insufficient, in another embodiment the lug 14' in the space A' between the panel and the holder 17 can be flexible.

What is claimed is:

1. A suspension mount for sound reproduction devices according to the flexural wave principle, with a panel (10) which is composed of a core layer (11) and two cover layers (12.1, 12.2), where the two cover layers (12) are connected to two opposite sides of the core layer (11), with a holder (17) and with flexible fastening devices which attach the panel (10) to the holder (17), characterized in that the flexible fastening devices as formed by the core layer (11) and/or by at least one of the two cover layers (12), characterized in that the core layer (11) has a perforated structure, where each opening (20) in this perforated structure extends vertically to the two cover layers (12), that a fastening part (14, 14') passes through at least one of the openings (20) to attach the panel (10) to the holder (17), and that at least one of the two cover layers (12) is located at a lateral distance (A1) from the opening or openings (20) containing the fastening part (14), in that a number of the laterally adjacent openings (20) that are equipped with the fastening part (14) are not covered by the cover layer or layers (12).

2. A suspension mount as claimed in claim 1, characterized in that the opening or openings (20) which are equipped with the fastening part (14), and/or the openings (20) which are laterally adjacent to the opening or openings (20) equipped with the fastening part (14), are filled with a plastic foam material.

3. A suspension mount as claimed in claim 2, characterized in that at least one of the two cover layers (12) is also located at a distance (A2) from the openings (20) that are filled with the plastic foam material.

4. A suspension mount as claimed in claim 3, characterized in that the opening or openings (20) that contain a fastening part (14), and/or those openings (20) which are not covered, or are only covered by one of the two cover layers (12), have a smaller length (L2) as opposed to the length (L1) of the openings (20) in the remaining core layer (11).

5. A suspension mount as claimed in claim 1, characterized in that the holder (17) boxes in the panel (10) with a lateral space (A), and that at least one of the two cover layers (12) is connected to the holder (17) by bridging the lateral space (A).

6. A suspension mount as claimed in claim 5, characterized in that the areas of the cover layers (12) that bridge the lateral space (A) to the holder (17) have a corrugated or scalloped profile.

7. A suspension mount as claimed in claim 6, characterized in that the lateral space (A) between the panel (10) and the holder (17) contains electronic components (19) for driving the panel (10), which are connected to the holder (17).

8. A suspension mount as claimed in claim 5, characterized in that the lateral space A between the panel (10) and the holder (17) contains electronic components (19) for driving the panel (10), which are connected to the holder (17).

9. A suspension mount as claimed in claim 1, characterized in that the opening or openings (20) that contain a fastening part (14), and/or those openings (20) which are not covered, or are only covered by one of the two cover layers (12), have a smaller length (L2) as opposed to the length (L1) of the openings (20) in the remaining core layer (11).

10. A suspension mount for sound reproduction devices according to the flexural wave principle, with a panel (10) which is composed of a core layer (11) and two cover layers (12.1, 12.2), where the two cover layers (12) are connected to two opposite sides of the core layer (11), with a holder (17) and with flexible fastening devices which attach the panel (10) to the holder (17), characterized in that the flexible fastening devices are formed by the core layer (11) and/or by at least one of the two cover layers (12), further characterized in that the holder (17) boxes in the panel (10) with a lateral space (A), and that at least one of the two cover layers (12) is connected to the holder (17) by bridging the lateral space (A) and that the areas of the cover layers (12) that bridge the lateral space (A) to the holder (17) have a corrugated or scalloped profile.

* * * * *